United States Patent [19]

Yunan

[11] 4,426,933

[45] Jan. 24, 1984

[54] NON-ELECTRIC BLASTING ASSEMBLY

[75] Inventor: Malak E. Yunan, Boonton Township, Morris County, N.J.

[73] Assignee: E. I. Du Pont de Nemours and Company, Wilmington, Del.

[21] Appl. No.: 334,890

[22] Filed: Dec. 28, 1981

Related U.S. Application Data

[63] Continuation-in-part of Ser. No. 257,973, Apr. 27, 1981.

[51] Int. Cl.[3] ..... F42B 3/10

[52] U.S. Cl. ..... 102/275.3; 102/275.4; 102/275.7; 102/275.12

[58] Field of Search ..... 102/275.3, 275.4, 275.5, 102/275.6, 275.7, 275.12, 200

[56] References Cited

U.S. PATENT DOCUMENTS

| | | | |
|---|---|---|---|
| 3,175,491 | 3/1965 | Robertson | 102/275.7 |
| 3,205,818 | 9/1965 | Coulson | 102/275.4 |
| 3,306,201 | 2/1967 | Noddin | 102/275.3 |
| 3,349,706 | 10/1967 | Schaumann | 102/275.7 |
| 3,709,149 | 1/1973 | Driscoll | 102/312 |
| 3,713,384 | 1/1973 | Turnbull | 102/275.7 X |
| 4,024,817 | 5/1977 | Calder et al. | 102/275.7 X |
| 4,187,780 | 2/1980 | Petruccelli | 102/275.12 |
| 4,232,606 | 11/1980 | Yunan | 102/275.8 |
| 4,248,152 | 2/1981 | Yunan | 102/275.4 |
| 4,299,167 | 11/1981 | Bryan | 102/275.3 X |

OTHER PUBLICATIONS

E. I Du Pont de Nemours & Co., *Blasters' Handbook,* 175th Anniversary Ed., 1977, pp. 104 and 132.

*Primary Examiner*—David H. Brown

[57] ABSTRACT

A detonator closed at one end by a primer shell whose integrally closed end has a percussion-sensitive primer charge supported adjacent its inside surface, and its outside surface disposed across the end of the detonator shell, is actuated by the detonation of one or two lengths of low-energy detonating cord (LEDC) adjacent the primer shell's outside end surface, a single length of LEDC being arrayed in a manner such that a pair of axially separated segments thereof, or two lengths arrayed in a manner such that a segment from each length, is anchored in place in side-by-side relationship adjacent said surface. This cord array assures reliable ignition of a center- or rim-fired percussion primer by means of the side-output of LEDC even with explosive core loadings at the low end of the LEDC loading range. A preferred detonator has a sleeve having a loop-like projection, most preferably M-shaped, diametrically disposed beyond the primer shell end through which a looped length of LEDC can be threaded in various ways to hold the pair of segments adjacent the primer shell.

21 Claims, 14 Drawing Figures

Fig. 3.
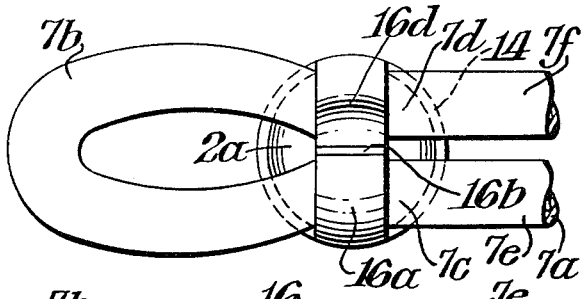
Fig. 1.
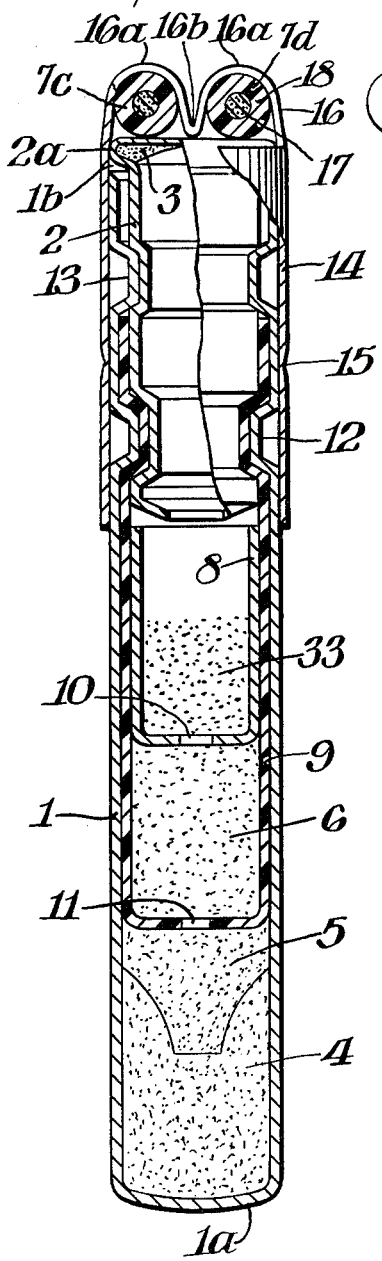
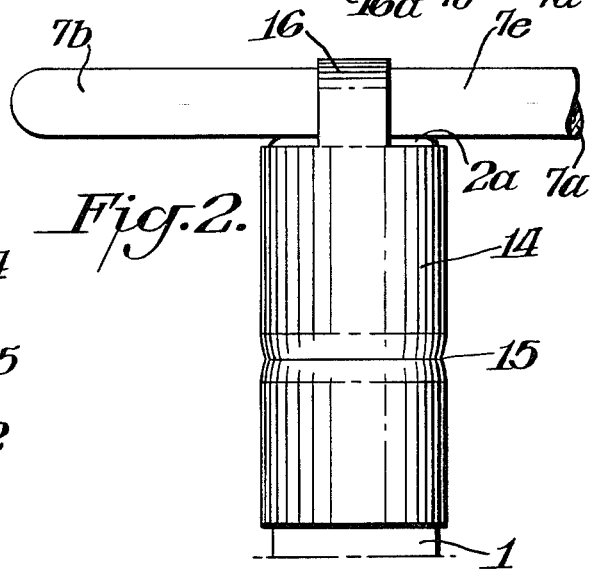
Fig. 2.
Fig. 4.
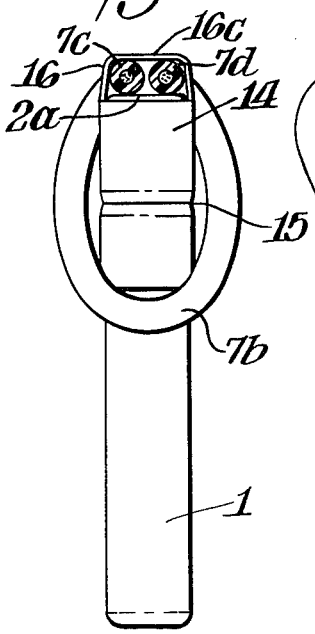
Fig. 5.
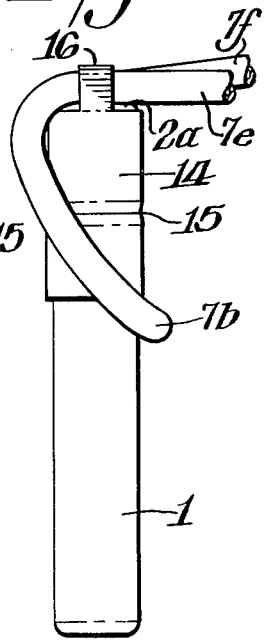

NON-ELECTRIC BLASTING ASSEMBLY

CROSS-REFERENCE TO RELATED APPLICATION

This application is a continuation-in-part of my copending Application Ser. No. 257,973, filed Apr. 27, 1981.

BACKGROUND OF THE INVENTION

1. Field of the Invention

The present invention relates to an assembly for initiating explosives comprising a percussion-actuated detonator and a low-energy detonating cord (LEDC) adjacent the detonator's percussion-responsive end for the actuation thereof. The invention also relates to a percussion-actuated detonator provided with means for holding LEDC adjacent its percussion-responsive end.

2. Description of the Prior Art

Detonating cords are used in non-electric blasting systems to convey or conduct a detonation wave to an explosive charge in a borehole from a remote area. One type of detonating cord, known as low-energy detonating cord (LEDC), has an explosive core loading of only about 0.1 to 2 grams per meter of cord length. Such a cord is characterized by low brisance and the production of little noise, and therefore is particularly suited for use as a trunkline in cases where noise has to be kept to a minimum, and as a downline for the bottom-hole priming of an explosive charge.

In blasting practice, an LEDC downline may be joined to an instantaneous or delay detonator attached to the blasting explosive charge, or to an explosive primer in said charge, in a borehole. Detonation of the LEDC actuates the detonator, which in turn initiates the blasting explosive charge or primer. The more sensitive the blasting explosive charge, the lower the explosive loading of the LEDC has to be to avoid detonation of the blasting charge before actuation of the detonator. With some blasting explosives, a cord loading as low as about 0.5 g/m or less may be desired.

At the surface, a delay detonator may be interposed between two lengths of LEDC trunkline to provide a surface delay. Also, if the LEDC is of a type which is incapable of "picking up", i.e., detonating, from the detonation of a donor cord with which it is spliced or knotted, e.g., to connect downlines to a trunkline, an instantaneous or delay detonator may be interposed between the trunkline and downline to act as a "starter" for the downline.

The most desirable cord-initiated detonators are those which do not require connection to the cord at the place of manufacture. A field-assembled detonator/-cord system offers such advantages as safety and convenience during handling and storage, possible separate classification of the components for transportation, etc.

U.S. Pat No. 4,335,652, issued June 22, 1982, describes a delay detonator adapted to be assembled in the field with a length of LEDC which is placed in coaxial position in an open cavity in the detonator, thereby making the detonator particularly useful as an in-hole delay initiator when connected to an LEDC downline. In this assembly the detonator is initiated by the exposed end of the cord.

U.S. Pat. No. 4,299,167, issued Nov. 10, 1981, describes an initiator for introducing a delay between two lengths of LEDC trunkline or an LEDC trunkline and LEDC downline. This surface delay initiator is actuated from the side output of a donor cord, and end-initiates a receiver cord. The donor cord is engaged in a transverse slot in a tubular connector having a bore for receiving the initiator.

U.S. Pat. No. 3,709,149 also describes a delay detonator adapted to be assembled in the field with a length of LEDC, the cord in this case being disposed outside a closed shell that contains an impact-sensitive ignition composition held, for example, in an empty primed rim-fired or center-fired rifle cartridge casing used as an end closure for the detonator. The end or side of the cord is in direct and abutting contact with the exterior surface of the primer end, thereby permitting utilization of either the side or end output of the cord for ignition. This detonator generally is positioned in a booster unit embedded in an explosive charge in a borehole.

Among percussion-actuated detonators, those having a partially empty, tubular metal primer shell, e.g., a primed rifle cartridge casing, as the percussion-responsive element are preferred on the basis of convenience of manufacture, accessibility of components, etc. With respect to cord orientation in LEDC/detonator assemblies, placement of the cord transverse to the axis of the detonator shell is preferred over a coaxial orientation, which requires that the cord be cut to provide an abutting end surface. However, regardless of whether or not the primer charge in the primer shell is at the center or along the rim of the end of the shell, the transversely oriented LEDC must be carefully placed and maintained against the end of the primer shell if the primer charge is to be ignited reliably by the cord's detonation. Especially with cords having explosive loadings below about 1.0 g/m, the proper relationship between the cord and the outside surface of the primer shell at the time of cord detonation is critical in view of the fact that the cord's initiation impulse must be transmitted through the side wall of the cord (e.g., a protective covering of plastic, woven textiles, etc.) and the end of the primer shell. During field assembly it is possible that the side of the cord may not properly abut the primer end surface, or that a foreign substance may become lodged between them. Also, the orientation of cord and primer surface may be disturbed during ensuing operations to prepare for blasting.

Therefore, the art has been in need of a means of achieving reliable actuation under field assembly conditions of detonators in which a primer charge in a partially empty, tubular metal primer shell is to be initiated by the side-output of a low-energy detonating cord.

SUMMARY OF THE INVENTION

The present invention provides an improvement in a non-electric blasting assembly comprising (a) a percussion-actuated detonator comprising a tubular metal detonator shell integrally closed at one end and closed at the other end by a partially empty, shorter tubular metal primer shell having an open end and supporting a percussion-sensitive primer charge adjacent the inside surface of an integrally closed end, the primer shell, e.g., an empty primed rifle cartridge casing, for example for 0.22 caliber ammunition, extending open end first into the detonator shell to dispose the outside surface of its primer charge end across the end of the detonator shell, the detonator shell containing, in sequence from its integrally closed end, (1) a base charge of a detonating explosive composition, (2) a priming charge of a heat-sensitive detonating explosive composition, and, optionally, (3) a delay charge of an exothermic-burning composition; and (b) low-energy detonating cord (LEDC) adjacent the outside end surface of the primer shell. The improvement of the invention comprises a length of LEDC arrayed in a manner such that a pair of axially separated segments thereof are anchored in place, or two lengths of LEDC arrayed in a manner such that a segment from each length is anchored in place, in side-by-side relationship adjacent, and preferably substantially in contact with, the outside end surface of the primer shell.

The term "axially separated segments" as used herein denotes two segments of the same length of cord which are connected by a third segment. For example, in a length of cord which is looped so as to form a U-shaped or circular portion with arm portions adjacent thereto, the U-shaped or circular portion is a segment that connects two "axially separated" segments in the arm portions.

The term "side-by-side" relationship as used herein to describe the relative orientation of the cord segments adjacent the primer shell end surface denotes either (a) that the two segments, which can be straight or curved, e.g., U-shaped, are both positioned next to the primer shell surface with their facing sides near or contacting one another, or (b) that a first segment is next to the primer shell surface and the other atop the first.

The presence of two axially separated segments of a length of LEDC adjacent the outside end surface of the primer shell allows the primer charge, upon detonation of the length of cord, to be impacted twice in rapid succession, which condition has been found to result in reliable ignition of the primer charge even with an explosive core loading at the low end of the LEDC loading range and even when the primer charge is peripheral, while the integrity of the primer and detonator shells is maintained.

A means for affixing and holding one or two lengths of LEDC in a manner such as to provide the required pair of segments adjacent the primer shell is integral with, or fitted on or into, the detonator shell. For an "in-hole" detonator, i.e., one which is to be placed in an explosive charge in a borehole, the LEDC-affixing and-holding means preferably is a sleeve which fits over the primer shell end of the detonator shell and has a projection in the form of a loop, bail, or half-hoop diametrically disposed beyond the integrally closed end of the primer shell. A preferred loop-like projection is one which can accommodate the length(s) of cord in a manner such that the two cord segments are both positioned next to the primer shell surface. In this embodiment, a length of LEDC can be threaded through the projection on the sleeve in various ways in the form of a loop so that two cord segments in the arm portions of the loop are held in the described position.

For a "surface" detonator, e.g., one which is to be used between two lengths of trunkline or between a trunkline and a downline, the detonator can be positioned within a cord-connector which includes means for holding a cord adjacent both ends of the detonator, a pin or other locking means being used, for example, to hold the apexes of two U-shaped segments of cord, or two segments in the arm portions of a looped length of cord, adjacent the primer shell surface.

This invention also provides an improved percussion-actuated detonator, especially adapted to be used in the LEDC/detonator assembly of the invention. In the detonator described above with respect to the LEDC-/detonator assembly of the invention, the present invention provides the improvement comprising a sleeve which fits over the primer shell end of the detonator shell, which sleeve has a generally M-shaped loop-like projection diametrically disposed beyond the integrally closed end of the primer shell, the loop-like projection being adapted to have one or two lengths of LEDC threaded therethrough to form a pair of segments anchored in place in side-by-side relationship adjacent the outside end surface of the primer shell.

BRIEF DESCRIPTION OF THE DRAWING

In the accompanying drawing, which illustrates specific embodiments of the detonator and the LEDC-/detonator assembly of the invention:

FIG. 1 is a front elevation in partial cross-section of an LEDC/detonator assembly of the invention including a percussion-actuated detonator having a preferred cord-connecting sleeve at its actuation end;

FIG. 2 is a side elevation of a portion of the assembly shown in FIG. 1;

FIG. 3 is a plan view of the assembly shown in FIG. 1;

FIGS. 4 and 5 are front and side elevations, respectively, of an LEDC/detonator assembly of the invention including a detonator having a cord-connecting sleeve of different configuration from that shown in FIG. 1;

DETAILED DESCRIPTION

Figure 8:
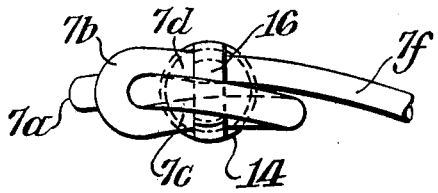
FIG. 8 is a plan view of the assembly shown in FIG. 7.

Referring to FIG. 1, tubular metal detonator shell 1 is integrally closed at one end 1*a* and closed at the other end 1*b* by an ignition assembly comprising metal primer shell 2, in this case a rim-fired empty primed rifle cartridge casing. Shell 2 has an open end and an integrally closed end which peripherally supports on its inner surface a percussion-sensitive primer charge 3 for rim-firing. Shell 2 extends open end first into shell 1 to dispose the outside surface 2*a* of the integrally closed end adjacent, and across, end 1*b* of shell 1.

Starting from end 1*a*, shell 1 contains four powder charges in the following sequence: base charge 4 of a pressed detonating explosive composition; priming charge 5 of a pressed heat-sensitive detonating explosive composition; delay charge 6 of a pressed exothermic-burning composition; and a loose flame-sensitive ignition charge 33. A free space intervenes between ignition charge 33 and percussion-sensitive primer charge 3, thereby permitting the flame emitted from the ignition of charge 3 to directly contact charge 33, ignite it, and allow it to burn instantaneously. Delay charge 6 is held in capsule 9, made of a polyolefin or polyfluorocarbon. Capsule 9 is nested within shell 1, and metal capsule 8 within capsule 9, and capsules 8 and 9 both have one open extremity and a closure at the other extremity provided with an axial orifice therethrough, i.e., orifices 10 and 11, respectively. The closure which contains orifice 10 is seated against delay charge 6, and that which contains orifice 11 against priming charge 5, charges 4, 5, and 6 being in a direct train along the detonator's longitudinal axis by virtue of orifice 11.

In the percussion-actuated detonator shown in FIG. 1, plastic capsule 9 fits around the innermost portion of primer shell 2 so as to terminate and be sandwiched between the walls of shell 2 and shell 1 while allowing the wall portion of shell 2 adjacent closed end 2*a* to remain in contact with the wall of shell 1. Circumferential crimp 12 jointly deforms the walls of shells 1 and 2 and capsule 9. Circumferential crimp 13 jointly deforms the walls of shells 1 and 2.

Fitted over the primer shell end of detonator shell 1 is a metal sleeve 14, which is held in place by circumferential crimp 15. The tubular portion of sleeve 14 terminates near, and just short of, the periphery of the outside end surface 2*a* of primer shell 2, at which terminus sleeve 14 is provided with a projection 16 in the form of an M-shaped loop or band diametrically disposed beyond surface 2*a*. The distance between surface 2*a* and projection 16 in the two arched portions 16*a* of the M is large enough to allow passage of a length of the LEDC to be employed to actuate the detonator. The central notched portion 16*b* extends substantially to surface 2*a*.

FIGS. 1, 2, and 3 show the detonator assembled with a length of LEDC according to the invention. The LEDC comprises a core of detonating explosive 17 surrounded by a protective plastic sheath 18. The length of LEDC has a free end 7*a* which has been threaded first through one arched portion 16*a* in a given direction, and then through the other in a reverse direction, thereby forming a loop of cord having a U-portion 7*b* and arm portions 7*e* and 7*f* adjacent thereto, and positioning two axially separated segments 7*c* and 7*d* of said arm portions, respectively, adjacent, and substantially in contact with, surface 2*a* of primer shell 2. Of course, if another free end of the length of LEDC is available, the cord connection can be made by threading both ends through portions 16*a* in the same direction. The U portion 7*b* of the looped cord, which portion is a segment that connects segments 7*c* and 7*d*, can remain extended beyond the confines of the detonator wall as shown, or sufficient tension can be applied to the arm portions 7*e* and 7*f* to position U portion 7*b* along the rim of the primer shell. In the latter case, the cord segment that connects the axially separated segments also is adjacent the primer shell surface. In both cases, axially separated segments of cord 7*c* and 7*d* are in side-by-side relationship adjacent surface 2*a*, and remain so when tension is applied to the cord arm portions, although the degree of axial separation between segments 7*c* and 7*d* will change as the degree of extension of the U portion 7*b* of the loop with respect to the confines of the detonator is changed. Notched portion 16*b* acts as a stop to prevent the loop of cord from becoming unthreaded from projection 16 when tension is so applied.

In the detonator shown in FIGS. 4 and 5, cord-connecting sleeve 14 is held in place around shell 1 by circumferential crimp 15, as in the detonator shown in FIG. 1. In this case, however, projection 16 is in the form of a sharp-cornered U-shaped loop or staple. The distance between surface 2*a* of primer shell 2 and surface 16*c* of projection 16 is the same over substantially the entire diameter of surface 2*a*. This allows a U-shaped loop of LEDC to be formed in the cord length and then threaded, U first, through projection 16. This embodiment is convenient when the cord/detonator connection is to be made in a portion of cord having no available free ends. The assembly can be formed by threading the U portion 7*b* through projection 16, then passing it over end 1*a* of detonator shell 1 so as to return portion 7*b* to the side of the detonator from which it has been threaded, and applying tension to one or both of the adjacent arm portions 7*e* and 7*f* of the looped cord, whereby detonator shell 1 prevents portion 7*b* from becoming unthreaded through projection 16.

Figure 6:
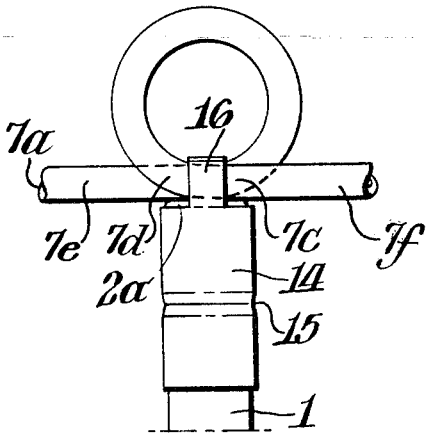
FIGS. 6 and 7 are side elevations of portions of LEDC/detonator assemblies of the invention including a detonator having the cord-connecting sleeve shown in FIG. 1 or 4 with the LEDC threaded and anchored in alternative ways.
Figure 7:
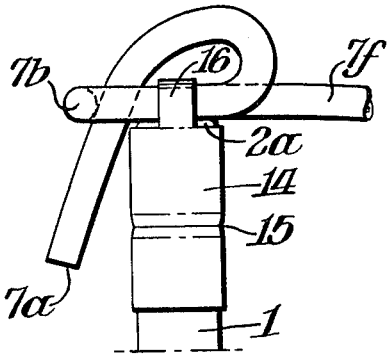

The cord connections shown in FIGS. 6 and 7 are made through the U-shaped projection 16 shown in FIG. 4 or the M-shaped projection 16 shown in FIG. 1. In the FIG. 6 assembly, a free end 7*a* of a length of LEDC has been threaded through projection 16 in a given direction, and a second time in the same direction after the end of the cord has been doubled back to form a loop. In this case, the two axially separated segments of cord 7*c* and 7*d* adjacent surface 2*a* of the primer shell are connected by a substantially circular segment of cord whose diameter may be reduced by the application of tension to one or both arm portions 7*e* and 7*f* of the looped cord, while the required side-by-side relationship of segments 7*c* and 7*d* is preserved.

In the assembly shown in FIGS. 7 and 8, the cord length can be threaded through the M- or U-shaped projection 16 in the manner described with respect to FIG. 1 inasmuch as a free cord end 7*a* is available. In addition, with a U-shaped projection like that shown in FIG. 4, a pre-formed loop of LEDC can be threaded, U first, through projection 16. The free cord end 7*a* then is doubled back over projection 16 and threaded through the U portion 7*b* of the looped cord. Tension can be applied to arm portion 7*f* to the degree necessary to keep the free end locked in place in portion 7*b*.

Figure 9:
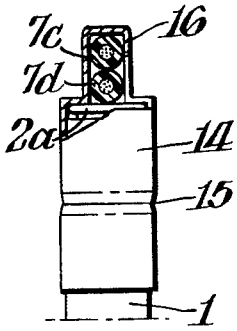
FIG. 9 is a front elevation in partial cross-section of a portion of an LEDC/detonator assembly of the invention having a sleeve for connecting a pair of cord segments side-by-side one atop the other.

The detonator shown in FIG. 9 has a cord-connecting sleeve 14 carrying projection 16, which is a U-shaped loop or staple dimensioned to accommodate two axially separated segments 7*c* and 7*d* of a length of LEDC, or two segments 7*c* and 7*d*, each from a different length of LEDC, in side-by-side contacting relationship one atop the other. In this less-preferred embodiment, the two segments 7*c* and 7*d* can be the apexes of two U-shaped segments of LEDC which are nested one within the other. Alternatively, they can be two segments from the same length of LEDC folded as shown in FIG. 3 or 6 except that a first segment, 7*d*, is next to the primer shell and the other, 7*c*, is atop 7*d*.

Figure 10:
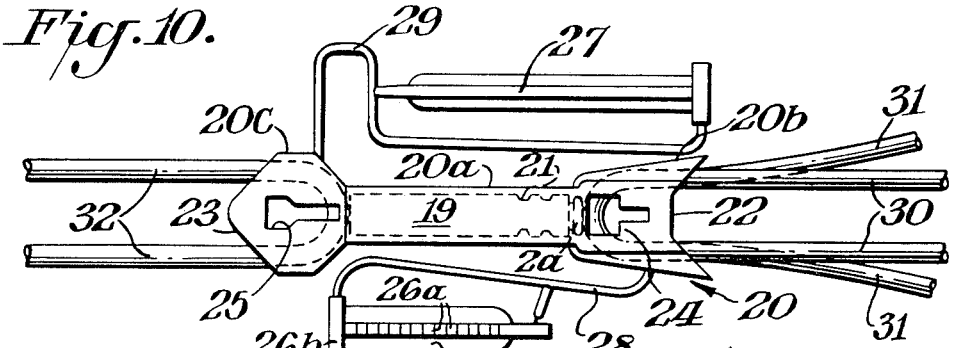
FIG. 10 is a plan view of an assembly of substantially U-shaped portions of donor and receiver detonating cords and a detonator held in a directional connector with the cords in detonation-propagating relationship to the input and output ends of the detonator, which assembly includes the LEDC/detonator assembly of the invention.
Figure 11:
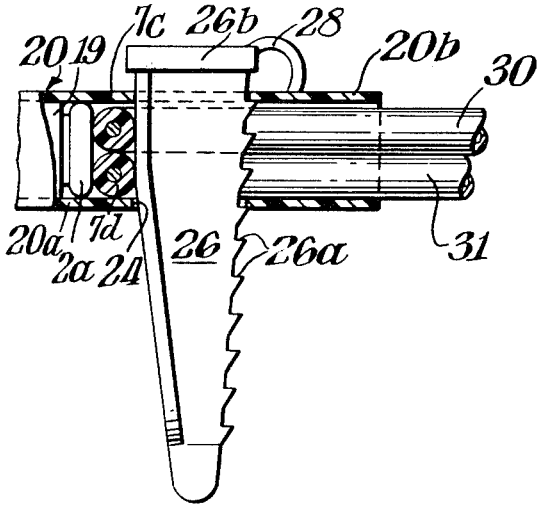
FIG. 11 is cross-sectional view of a portion of the assembly shown in FIG. 10, the cross-section being in a plane substantially normal to the plane in which the cords lie.

Referring to FIGS. 10 and 11, 20 is a connector for holding LEDC in contact with the ends of a detonator 19. Connector 20 is a hollow body, typically one-piece and made of thermoplastic material, having a central tubular portion 20*a* with an axial bore 21 which communicates at each of its ends with the hollow interiors of cord-receiving sections 20*b* and 20*c*. Sections 20*b* and 20*c* are flat, hollow bodies that are somewhat similar in configuration except at their free open ends 22 and 23, respectively. This configuration is generally that of a semi-elliptic arch (paraboloid) having a major axis that is coaxial with the longitudinal axis of bore 21. The minor axis of the paraboloid is the major axis of its cross-sectional ellipse, and its height (or the thickness of the flat body) is the minor axis of the cross-sectional ellipse. The diameter of bore 21 is such that it peripherally engages detonator 19, a snug force fit being preferred. The height of section 20*b* along the major axis of the paraboloid is sufficient to facilitate insertion of detonator 19 into bore 21.

Ends 22 and 23 of sections 20*b* and 20*c*, respectively, are so configured that they constitute means for identifying the input and output ends of detonator 19, the input end being the end closed by the primer shell, and the output end being the integrally closed, base-charge end. Together with tubular portion 20*a*, sections 20*b* and 20*c* form a hollow arrow, with section 20*c* having the shape of the head, and section 20*b* the butt, of the arrow. With this configuration as a guide, detonator 19 is inserted into bore 21 with its output end close to the head-shaped section, 20*c*, and its input (actuation) end adjacent the butt-shaped section, 20*b*. Once the detonator is in place in bore 21, the user immediately recognizes the input and output ends of detonator 19 by the shape of sections 20*b* and 20*c*.

Detonator 19 is the detonator shown in FIG. 1, connecting sleeve 14 being absent.

A pair of matching oppositely disposed T-shaped apertures 24 and 25 extend transversely through sections 20*b* and 20*c*, respectively, each pair of apertures lying in planes which are parallel to the longitudinal axis of bore 21. The legs of T-shaped apertures 24 and 25 run parallel to the longitudinal axis of bore 21, apertures 24 having their head portions, and apertures 25 their leg portions, nearest bore 21. The head portions of apertures 24 are wider (i.e., larger in dimension in a direction normal to the longitudinal axis of bore 21) than the head portions of apertures 25.

Tapered pin 26 is mateable with apertures 24, and tapered pin 27 with apertures 25. The pins are shown in their as-molded position in FIG. 10, and pin 26 is shown in its operating position in FIG. 11. The surface 26*a* of pin 26, which is the end surface of the leg of a T, is serrated. The serrated surface of pin 27 is the top surface of the T. The serrated surfaces allow pins 26 and 27 to tightly engage the periphery of apertures 24 and 25, respectively. The remaining surfaces of the pins are smooth. Pins 26 and 27 are integrally connected to sections 20*b* and 20*c*, respectively by thin flexible webs of plastic 28 and 29, respectively. This positioning of the webs permits pins 26 and 27 to be inserted into apertures 24 and 25, respectively, from either the top or bottom of the connector, positioned as shown in FIG. 11.

Two lengths of LEDC 30 and 31 have U-shaped portions housed side-by-side within donor-cord-housing section 20*b* in a manner such that the apexes of U-shaped segments 7*c* and 7*d* are wedged against surface 2*a* when pin 26 is in place in apertures 24. The width of the head portions of apertures 24 is sufficient to provide long enough apex segments of cord to assure reliable initiation of the primer charge 3 in the rim portion of shell 2. The two U-shaped segments 7*c* and 7*d* also can be provided by a suitably folded single length of cord, however.

At the output end of detonator 19, detonating cord 32 has a U-shaped portion housed within receiver-cord-housing section 20*c* in a manner such that the apex of a U-shaped segment is wedged against the bottom of detonator 19 when pin 27 is in place in apertures 25.

In operation, the detonation of cords 30 and 31, whose side walls are in contact with the input end of detonator 19, causes the percussion-sensitive primer charge 3 to ignite, and in turn to ignite charge 33, and initiate delay charge 6, priming charge 5, and base charge 4. Detonation of charge 4 causes cord 32 to detonate.

Figure 12:
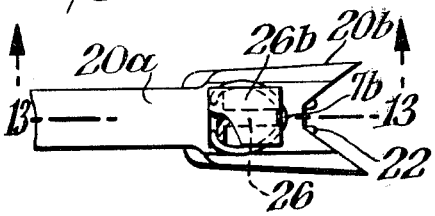
FIGS. 12 and 13 are a plan view and side elevation, respectively, of a portion of the assembly shown in FIG. 10 except with a different LEDC/detonator assembly of the invention.
Figure 13:
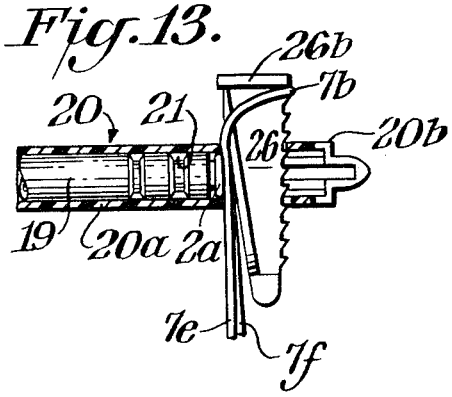

In the embodiment shown in FIGS. 12 and 13, a length of LEDC which has been doubled back so as to form a U-shaped loop of cord is threaded through the head portion of T-shaped apertures 24 so as to position two axially separated segments of the cord length side-by-side therein adjacent the primer end surface 2*a*. The U-portion 7*b* of the looped cord is bent back toward the base of the leg of T-shaped apertures 24, and pin 26 is inserted into apertures 24 through U-portion 7*b* of the cord. The pin has an over-hanging head portion 26*b* which prevents portion 7*b* of the cord from being pulled through the apertures when tension is applied to cord arm portions 7*e* and 7*f*.

Figure 14:
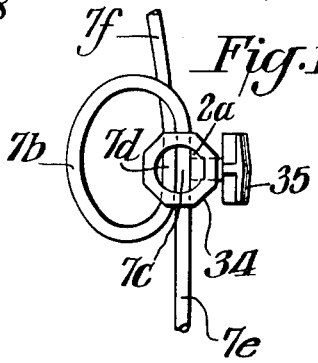
FIG. 14 is a front elevation, of the LEDC/detonator assembly of the invention held in the connector body shown in U.S. Pat. No. 4,299,167.

The connector shown in FIG. 14 and is essentially the one shown in FIG. 2 of U.S. Pat. No. 4,299,167, and comprises a tube 34 of preferably electrically nonconductive material, e.g., a plastic material, having open extremities and, near one of its extremities, a transverse slot communicating with the bore of the tube. The slot has a recessed channel which engages a length of LEDC looped as shown in FIG. 14. Detonator 19 is seated in the bore of tube 34. Surface 2*b* of shell 2 is adjacent the transverse slot which holds the looped LEDC. Tube 34 has slotted locking means 35 adapted to form a closure with the transverse slot to lock the looped LEDC in place.

Example 1

Referring to the assembly of FIG. 1, cord segments 7*c* and 7*d* were axially separated segments of a single length 7 of the LEDC described in Example 1 of U.S. Pat. No. 4,232,606. This cord had a continuous solid core 17 of a deformable bonded detonating explosive composition consisting of a mixture of 75% superfine PETN, 21% acetyl tributyl citrate, and 4% nitrocellulose prepared by the procedure described in U.S. Pat. No. 2,992,087. The superfine PETN was of the type which contained dispersed microholes prepared by the method described in U.S. Pat. No. 3,754,061, and had an average particle size of less than 15 microns, with all particles smaller than 44 microns. Core-reinforcing filaments derived from six 1000-denier strands of polyethylene terephthalate yarn were uniformly distributed on the periphery of the explosive core 17. The core and filaments were enclosed in a 0.9-mm-thick low-density polyethylene sheath 18. The diameter of core 17 was 0.8 mm, and the cord had an overall diameter of 2.5 mm. The PETN loading in core 17 was 0.53 g/m.

Detonator shell 1, made of Type 5052 aluminum alloy, was 44.5 mm long, and had an internal diameter of 6.5 mm and a wall thickness of 0.4 mm. Capsule 9 was made of high-density polyethylene, was 21.6 mm long, and had an outer diameter of 6.5 mm and an internal diameter of 5.6 mm. Axial orifice 11 was 1.3 mm in diameter. Capsule 8, made of type 5052 aluminum alloy, was 11.9 mm long, and had an outer diameter of 5.6 mm and a wall thickness of 0.5 mm. Axial orifice 10 was 2.8 mm in diameter. Base charge 4 consisted of 0.51 gram of PETN, which had been placed in shell 1 and pressed therein at 1300 Newtons with a pointed press pin. Priming charge 5 was 0.17 gram of dextrinated lead azide. Capsule 9 was placed over charge 5 and pressed at 1300 Newtons with an axially tipped pin shaped to prevent the entrance of charge 5 into capsule 9 through orifice 11. Delay charge 6, which was loosely loaded into capsule 9, was 0.8 gram of a mixture of boron and red lead containing 0.9 percent by weight of boron. Capsule 8 was seated in capsule 9 over delay charge 6 at 1300 Newtons. Charge 33 was a loose load of 0.2 gram of a 2.5/97.5/20 (parts by weight) mixture of boron, red lead, and silicon. Shell 2 and charge 3 constituted a 0.22-caliber rim-fired empty primed rifle cartridge casing. It was seated in the end of shell 1 adjacent end 1*b*. Crimps 12 and 13 were 5.3 mm in diameter.

Sleeve 14, made of bronze, was 15.5 mm long. Projection 16 was 2.8 mm wide, and arched portions 16*a* were 3.8 mm high. Notched portion 16*b* was in contact with surface 2*a*.

The length of LEDC 7 was affixed to the detonator as described previously in the description of FIGS. 1, 2, and 3, and the LEDC was initiated in one arm of the looped cord. The segment of cord between segments 7*c* and 7*d* was 25 mm long. Initiation of the LEDC consistently actuated the detonator.

As was mentioned previously, it has been found that a center- or rim-fired percussion primer can be ignited reliably by means of the side-output of a low-energy detonating cord adjacent the end of the primer shell when the cord is present in the form of a pair of segments from a single length, or two different lengths, of cord, even at the low end of the LEDC loading range. Understandably, ignition of all primers is important in field operations.

The improved reliability at the low end of the LEDC loading range obtained with the present assemblies is shown by the following series of experiments:

The detonator described in Example 1 was tested for ignition and delay timing when fired in air and in water in an assembly with a pair of LEDC segments as described in Example 1, and also in an assembly wherein a length of the described LEDC was threaded through only one section 16*a* of the M-shaped projection, thereby positioning a single segment of the cord adjacent the primer shell. Fifty detonators were in each sampling. All detonators fired and timed well under water confinement, regardless of whether one or two LEDC segments were adjacent the primer shell. However, in air, only 95% of the detonators fired with a single segment of the LEDC, whereas 100% fired with the pair of LEDC segments. Attempts to fire the failed detonators with a second single segment of the same LEDC were only 50% successful.

The same study made on the LEDC described in Example 1 except having a core explosive loading of 0.36 g/m resulted in 80% failures in air in detonators fired with a single segment of LEDC, whereas 100% fired with the pair of segments.

The following experiments show that problems of reliability and performance encountered with a given LEDC may not be solved by using a cord having a larger explosive load arrayed with a single segment thereof adjacent the primer, an expedient, moreover, which cannot be resorted to in many instances, such as those in which the LEDC explosive load has to be small enough to prevent it from detonating an adjacent explosive charge in a borehole before the cord actuates the detonator.

The detonator described in Example 1 was employed in two series of experiments. In both series, five detonators were threaded to position the described cord adjacent the primer. In one series, a cord having an explosive loading of 2.1 g/m was positioned in a manner such that a pair of side-by-side segments were adjacent the primer as in Example 1. In the other series, a single segment of a cord having an explosive loading of 3.8 g/m was adjacent the primer. With the two segments of the 2.1 g/m cord (total loading 4.2 g/m), all detonators fired giving the expected delay timing (~300 milliseconds). With the single segment of the 3.8 g/m cord, the detonators fired at delays of about 1700 milliseconds, indicating that the detonators most likely had vented, destroying their reliability with respect to the intended delay.

These experiments show that the placement of a heavier cord (i.e., one having a greater explosive loading in its core) adjacent the primer shell surface entails the risk that the loading may be so great as to rupture the primer shell, causing a malfunction. Also, when a detonator which has failed to be actuated by impact from a length of LEDC detonating adjacent a primer therein is later re-impacted in an assembly with a new length of the same LEDC adjacent the primer, the detonator is not actuated reliably owing possibly to the dislodgment of the primer as a result of the first impact. Surprisingly, however, the rapid dual impacting which results when two separated segments of LEDC are present adjacent the primer shell overcomes the disadvantages of unreliable primer charge actuation and shell rupture.

The LEDC used in the assembly of the invention is a detonating cord having an explosive core in a loading of up to about 2 grams, preferably up to about 1 gram, per meter of cord length. Usually, the explosive loading is at least about 0.1, preferably at least 0.2, gram per meter. A preferred cord is the one described in U.S. Pat. No. 4,232,606. This cord is light-weight, flexible, and strong, detonates at high velocity, and is readily adapted to high-speed continuous manufacturing techniques. Other cords which can be used include the one described in U.S. Pat. No. 3,125,024, which has a core of granular PETN having a specific surface of about from 900 to 3400 square centimeters per gram confined within a woven textile sheath.

As was mentioned previously, the pair of segments of LEDC adjacent the outside end surface of the primer shell, when present in a single length of LEDC, are axially separated. This means that they are connected by a third segment of the same length of cord, e.g., the U-shaped segment between segments 7*c* and 7*d* shown in FIGS. 3, 4, and 8, and the circular segement between segments 7*c* and 7*d* in FIG. 6. The length of the connecting segment and the detonation velocity of the explosive core will determine the time which elapses between the detonations of the two separated segments. The shortest length of connecting segment that can be used is that of a U-shaped segment of a looped cord threaded as shown in FIG. 3 but with the cord pulled sufficiently to position the U-portion along the rim of the primer shell. As a practical matter, the connecting segment usually is no longer than about 30–40 cm. To achieve the beneficial effect of the rapid dual impacting of the primer, usually no more than about 2 milliseconds should elapse between the detonations of the two segments of the same length, or two lengths, of cord.

In the present assembly, the size of the LEDC used, i.e., the explosive loading of its core, will be matched to other parameters such as the sensitivity of the primer charge in the percussion primer, the thickness and composition of the primer shell, and the thickness and composition of the protective sheath around the cord's explosive core. Cords having an explosive loading at the upper end of the LEDC loading range may require a heavier primer shell to avoid shell rupture. If desired, the cord may be spaced from the primer shell by about 1.5 mm if there is risk of shell rupture with heavier cords. On the other hand, less-sensitive cords may require more-sensitive primer charges.

The means, e.g., a loop projection, for holding the LEDC segments against the primer shell can be integral with the detonator shell, or fitted on or into the detonator shell at the primer shell end thereof. A convenient holding means is a sleeve which fits over the primer shell end of the detonator shell, and can be assembled onto the detonator shell at the place of manufacture or in the field. Such a fitting can be made of metal or plastic, metal being preferred on the basis of greater ruggedness during the threading of the cord and subsequent handling. The pair of LEDC segments can be anchored in place by various means, such as those shown in the drawing. The shape of a projection on a sleeve (e.g., in the assembly shown in FIG. 1), a pin or other locking means (e.g., in the assemblies shown in FIGS. 11 and 13 and 15), and anchored cord loops all may be used singly and in combination to provide the required anchoring.

A readily available, and therefore preferred, primer shell for use in the present detonator and LEDC-/detonator assembly is an empty center- or rim-fired primed rifle cartridge casing, for example for 0.22 caliber ammunition. Such primer shells usually contain about 0.015 gram of percussion-sensitive material. As is customary, the detonator shell contains, in sequence from its integrally closed end, (1) a base charge of a detonating explosive composition, e.g., pentaerythritol tetranitrate (PETN), and (2) a priming charge of a heat-sensitive detonating composition, e.g., lead azide. In a delay detonator, a delay charge of an exothermic-burning composition, e.g., a boron-red lead mixture, is present in the sequence after the priming charge. A loose charge of a flame-sensitive ignition composition (33 in FIG. 1), e.g., lead dinitro-o-cresylate or a mixture of boron and/or silicon with red lead, is useful in delay detonators to provide improved uniformity of timing, and particularly reduced sensitivity of timing to minor variations in delay charge size.

A preferred delay detonator has a polyolefin or polyfluorocarbon carrier capsule or tube for the delay charge, as is described in U.S. Pat. No. 4,369,708, issued Jan. 25, 1983. This plastic carrier for the delay charge has a beneficial effect on delay timing inasmuch as it reduces the variability of the timing with changes in the surrounding temperature or medium (e.g., air vs. water). It also provides a better fit between the delay carrier and metal shell (and therefore a better seal for the priming charge) and eliminates the friction-related hazards associated with the fitting of a metal delay carrier into a metal detonator shell over a priming explosive charge. A carrier capsule has one open extremity and a closure at the other extremity provided with an axial orifice therethrough, the closure on the capsule being adjacent the priming charge.

A plastic tube or capsule adjacent the priming charge is preferred both in delay and instantaneous detonators because the wall of the tube or capsule can be made to terminate and be sandwiched between the walls of the detonator shell and the primer shell, affording an improved seal when a circumferential crimp is made which jointly deforms the walls of the detonator shell, the plastic tube or capsule, and the primer shell. In this embodiment, the wall portion of the primer shell adjacent its closed end remains in contact with the wall of the detonator shell to provide an electrical path between the shells.

In the cord-connecting sleeve 14 shown in FIG. 1, notched portion **16*b* of M-shaped projection 16 extends substantially to primer shell end surface 2*a*. While this is preferred, it is not necessary that portion 16*b* touch surface 2*a***, and the notch needs only to be deep enough to prevent the loop of cord from passing through it.

Cord-connecting sleeve 14 may be replaced by a sleeve which fits around primer shell 2, e.g., a metal or plastic sleeve having a split wall to facilitate its application to the primer. Primer shell 2 with sleeve 14 mounted thereon then can be inserted into the end of the detonator shell, whereby the sleeve is held between the walls of the two shells. The cord-connecting sleeve may be made long enough that the cord loop can be folded back across the projection on the sleeve so as to wedge the loop against the projection as tension is applied to one or both of the arm portions of the cord.

I claim:

1. In a non-electric blasting assembly comprising (a) a percussion-actuated detonator comprising a tubular metal detonator shell integrally closed at one end and closed at the other end by a partially empty, shorter tubular metal primer shell having an open end and supporting a percussion-sensitive primer charge adjacent the inside surface of an integrally closed end, said primer shell extending open end first into said detonator shell to dispose the outside surface of its primer charge end across the end of said detonator shell, said detonator shell containing, in sequence from its integrally closed end, (1) a base charge of a detonating explosive composition and (2) a priming charge of a heat-sensitive detonating explosive composition; and (b) low-energy detonating cord (LEDC) adjacent the outside end surface of said primer shell; the improvement comprising a length of LEDC arrayed in a manner such that a pair of axially separated segments thereof are anchored in place, or two lengths of LEDC arrayed in a manner such that a segment from each length is anchored in place, in side-by-side relationship adjacent the outside end surface of said primer shell.

2. A blasting assembly of claim 1 wherein said detonator and said length(s) of LEDC are held in a connector for holding donor and receiver detonating cords in propagating relationship to a detonator.

3. A blasting assembly of claim 1 wherein said length of LEDC is looped so as to form a U-shaped or circular cord portion with arm portions adjacent thereto, said pair of axially separated segments being located one in each of said arm portions.

4. A blasting assembly of claim 3 wherein said axially separated segments both are substantially in contact with said primer shell end surface.

5. A blasting assembly of claim 3 including a tube whose bore receives the input end of said detonator and which has, at one end thereof, a transverse slot communicating with said bore and engaging said length of LEDC so that said pair of segments are positioned adjacent the outside end surface of said primer shell, said tube being provided with locking means adjacent said transverse slot for preventing the disengagement of said looped cord therefrom.

6. A blasting assembly of claim 3 including a sleeve which fits over the primer shell end of said detonator shell, or is sandwiched between said primer shell and said detonator shell, said sleeve having a loop-like projection diametrically disposed beyond the integrally closed end of said primer shell, and said length of LEDC being threaded through said projection.

7. A blasting assembly of claim 6 wherein said projection is U- or M-shaped and one free end of said length of LEDC is threaded through said projection in a given direction and a second time in the same direction after said cord end has been doubled back to form a circular cord portion whose diameter may be reduced by the application of tension to one or both of the arm portions adjacent thereto.

8. A blasting assembly of claim 6 wherein said length of LEDC is threaded through said projection in a manner such that a U-shaped portion thereof extends beyond the wall of said detonator shell.

9. A blasting assembly of claim 6 wherein said length of LEDC is threaded through said projection in a manner such that a U-shaped portion thereof is positioned along the rim of the integrally closed end of said primer shell.

10. A blasting assembly of claim 8 wherein said projection is U- or M-shaped, and a free end of said length of LEDC is doubled back over said projection and threaded through said U-shaped portion of cord, said free end being locked in place in said U-shaped portion of cord when tension is applied to an arm portion adjacent thereto.

11. A blasting assembly of claim 8 wherein said projection is U-shaped, and said U-shaped portion of cord is passed over the integrally closed end of said detonator shell to the opposite side thereof whereby said U-shaped portion of cord is wedged against the detonator shell as tension is applied to one or both of said arm portions.

12. A blasting assembly of claim 8 or 9 wherein said projection is M-shaped and so dimensioned as to prevent the passage of said U-shaped portion of cord therethrough when tension is applied to one or both of said arm portions.

13. In a non-electric blasting assembly comprising:

(a) a percussion-actuated detonator comprising a tubular metal detonator shell integrally closed at one end and closed at the other end by a partially empty, shorter tubular metal primer shell having an open end and supporting a percussion-sensitive primer charge adjacent the inside surface of an integrally closed end, said primer shell extending open end first into said detonator shell to dispose the outside surface of its primer charge end across the end of said detonator shell, said detonator shell containing, in sequence from its integrally closed end, (1) a base charge of a detonating explosive composition and (2) a priming charge of a heat-sensitive detonating explosive composition;

(b) a substantially U-shaped segment of a length of receiver detonating cord held with its apex adjacent the integrally closed end of said detonator shell; and (c) low-energy detonating cord (LEDC) adjacent the outside end surface of said primer shell; the improvement comprising a length of LEDC arrayed in a manner such that a pair of axially separated segments thereof are anchored in place, or two lengths of LEDC arrayed in a manner such that a segment from each length is anchored in place, in side-by-side relationship adjacent the outside end surface of said primer shell.

14. A blasting assembly of claim 1 or 13 wherein said LEDC comprises a core of granular pentaerythritol tetranitrate having a specific surface of about from 900 to 3400 square centimeters per gram confined within a woven textile sheath.

15. A blasting assembly of claim 1 or 13 wherein said LEDC comprises a continuous solid core of a deformable bonded detonating explosive composition comprising a crystalline high explosive compound selected from the group consisting of organic polynitrates and polynitramines admixed with a binding agent, the particles of crystalline high explosive compound in said composition having their maximum dimension in the range of about from 0.1 to 50 microns; and, surrounding said explosive core, protective sheathing comprising one or more layers of plastic material.

16. A blasting assembly of claim 15 wherein the explosive loading of said core of bonded explosive is about from 0.1 to 2 grams per meter of length.

17. A blasting assembly of claim 13 wherein said detonator and said lengths of cord are held in a connector comprising:

(a) a central tubular portion whose bore receives said detonator;

(b) a cord-housing section at each end of said tubular portion and communicating with the bore thereof; and (c) two tapered pins, one mateable with each of a pair of matched apertures oppositely disposed in each of said cord-housing sections, said pins being adpated to extend through said apertures in a manner such as to hold said cord segments adjacent the ends of said detonator.

18. A blasting assembly of claim 17 wherein said side-by-side segments are substantially U-shaped segments held with their apexes adjacent said primer shell end surface.

19. A blasting assembly of claim 17 wherein said side-by-side segments are substantially U-shaped segments held in apex-to-apex contact, a first of said segments being substantially in contact with said primer shell end surface, and a second nested within the first.

20. A blasting assembly of claim 17 wherein said side-by-side segments are segments of a length of LEDC which is looped so as to form a U-shaped cord portion with arm portions adjacent thereto, said pair of axially separated segments being located one in each of said arm portions.

21. In a percussion-actuated detonator comprising a tubular metal detonator shell integrally closed at one end and closed at the other end by a partially empty, shorter tubular metal primer shell having an open end and supporting a percussion-sensitive primer charge adjacent the inside surface of an integrally closed end, said primer shell extending open end first into said detonator shell to dispose the outside surface of its primer charge end across the end of said detonator shell, said detonator shell containing, in sequence from its integrally closed end, (1) a base charge of a detonating explosive composition and (2) a priming charge of a heat-sensitive detonating explosive composition, the improvement comprising a sleeve which fits over the primer shell end of said detonator shell, or is sandwiched between said primer shell and said detonator shell, said sleeve having a generally M-shaped loop-like projection diametrically disposed beyond the integrally closed end of said primer shell, and said loop being adpated to have one or two lengths of LEDC threaded therethrough to position a pair of segments anchored in place in side-by-side relationship adjacent the outside end surface of said primer shell.

* * * * *